US005289237A

United States Patent [19]

Hashizume et al.

[11] Patent Number: 5,289,237

[45] Date of Patent: Feb. 22, 1994

[54] DEVELOPING DEVICE AND METHOD FOR LOCATING A TONER RESTRICTING MEMBER AT A DEVELOPING DEVICE

[75] Inventors: Hiroshi Hashizume; Takashi Ishikawa, both of Tokyo, Japan

[73] Assignee: Kabushiki Kaisha Toshiba, Kawasaki, Japan

[21] Appl. No.: 935,186

[22] Filed: Aug. 26, 1992

[30] Foreign Application Priority Data

Aug. 27, 1991 [JP] Japan ..... 3-214959
Oct. 17, 1991 [JP] Japan ..... 3-269514

[51] Int. Cl.[5] ..... G03G 15/06

[52] U.S. Cl. ..... 355/245; 355/251; 355/259; 118/653; 118/656

[58] Field of Search ..... 355/245, 259, 260, 251, 355/253; 118/653, 656, 657, 658, 661

[56] References Cited

U.S. PATENT DOCUMENTS

| | | | |
|---|---|---|---|
| 3,696,785 | 10/1972 | Andrus | 355/259 X |
| 4,395,110 | 7/1983 | Hosono et al. | 118/657 X |
| 4,538,898 | 9/1985 | Kanno et al. | 118/657 |
| 4,674,441 | 6/1987 | Kohyama | 118/653 X |
| 4,780,741 | 10/1988 | Wada et al. | 355/253 |
| 4,896,625 | 1/1990 | Sakamoto et al. | 355/245 X |
| 4,935,784 | 6/1990 | Shigehiro et al. | 355/245 X |
| 5,045,886 | 9/1991 | Weitzel et al. | 355/245 X |
| 5,062,385 | 11/1991 | Nishio et al. | 118/653 |
| 5,095,341 | 3/1992 | Yoshida et al. | 118/653 X |
| 5,097,294 | 3/1992 | Nishio et al. | 355/245 |

FOREIGN PATENT DOCUMENTS

| | | |
|---|---|---|
| 0270104A3 | 6/1988 | European Pat. Off. . |
| 0354962A1 | 2/1990 | European Pat. Off. . |
| 0390605A3 | 10/1990 | European Pat. Off. . |

OTHER PUBLICATIONS

English Abstract of Japanese Application No. 59-150722 of T. Kubo, Japanese Patent Abstracts vol. 10, No. 183 (P-472) (2239), Jun. 26, 1986.

English Abstract of Japanese Application No. 58-153176 of K. Terao, Japanese Patent Abstracts vol. 9, No. 170 (P-373) (1893), Jul 16, 1985.

English Abstract of Japanese Application No. 56-167646 of H. Sugaya, Japanese Patent Abstracts vol. 7, No. 160 (P-210) (1305) Jul. 14, 1983.

European Search Report, App. No. EP 92 11 4553, dated Mar. 25, 1983, by Examiner H. Hoppe.

*Primary Examiner*—Matthew S. Smith

*Attorney, Agent, or Firm*—Finnegan, Henderson, Farabow, Garrett & Dunner

[57] ABSTRACT

A developing device includes a movable toner carrier having a surface which receives a toner, and a toner restricting member arranged parallel to the toner carrier. The toner restricting member comprises a retaining rod made of a rigid material and an elastic contact unit provided on the outer periphery of the retaining rod, extending in an axial direction along the retaining rod and having at least one contact area set in contact with the surface of the toner carrier.

25 Claims, 12 Drawing Sheets

DEVELOPING DEVICE AND METHOD FOR LOCATING A TONER RESTRICTING MEMBER AT A DEVELOPING DEVICE

BACKGROUND OF THE INVENTION

1. Field of the Invention

The present invention relates to a developing device for an electrophotographic apparatus which utilizes a one-component toner developing method.

2. Description of the Related Art

An electrostatic type electrophotographic apparatus for use, for example, in a copier, facsimile equipment or laser printer apparatus has a photosensitive drum with a photosensitive layer formed thereon. A charger, exposure device, developing device, transfer device and fixing device are located along and around the photosensitive drum.

As the photosensitive drum is rotated, a charge is formed by the charger on the surface (photosensitive layer) of the photosensitive drum and a toner is supplied by the developing device to the surface of the photosensitive drum to form a toner image on the drum surface.

Then a charge opposite in polarity to the charge on the toner image is applied to a recording paper sheet by the transfer device to allow the toner image on the drum surface to be transferred to the recording sheet under an electrostatic force. Finally, the toner image on the recording sheet is fixed by the fixing device.

Further, a cleaning device has to be provided so as to continuously perform a recording process. The toner remaining on the drum surface after transfer is removed by the cleaning device. The charge remaining on the drum surface is removed by the discharger, followed by a charging step in a continuous cycle.

Some developing devices to be mounted in an electrophotographic apparatus utilize a one-component toner developing method. In this type of device, a nonmagnetic toner not containing any carrier is pressed by a toner restricting member against the surface of a toner carrier whereby the toner is formed as a thin layer on the carrier surface, while being triboelectrically charged.

FIG. 40 shows this type of conventional developing device.

This developing device is located parallel to a photosensitive drum 9 and has a casing 1, agitator 2, toner feed roller 3, collecting blade 5 and toner restricting member 6.

The casing 1 has substantially the same length as that of the photosensitive drum and defines an inner space where a one-component toner T is stored. The casing 1 has an opening at which the developing roller 4 is located. The casing 1 is arranged parallel to the photosensitive drum 9.

The toner feed roller 3 and developing roller 4 have substantially the same length as that of the photosensitive drum 9 and are arranged parallel to the photosensitive drum 9 such that they are rotatably supported at the casing 1 side. The developing roller 4 is placed in contact with the outer peripheral surface of the drum 9, noting that the developing roller 4 is formed of electroconductive rubber and fixed to the outer periphery of a metal shaft 4*a*.

The toner restricting member 6 is located above the developing roller 4 in a manner to be parallel to the photosensitive drum 9. The toner restricting member 6 comprises a leaf spring 7 made of metal and a blade contact unit 8 made of an elastic material, such as rubber. The leaf spring and blade contact unit 8 have substantially the same length as that of the developing roller 4. The blade contact unit 8 is fixed to one side edge of the leaf spring 7 along its length. The other side edge of the leaf spring 7 is fixed to the casing 1. The blade contact 8 is placed, under an elastic force of the leaf spring 7, in contact with the outer periphery of the developing roller 4.

The operation of the developing device is as follows:

A nonmagnetic one-component toner T in a toner storage area of the casing 1 is fed to the toner feed roller 3 by the rotation of the agitator 2. The toner feed roller 3 and developing roller 4 are rotated by a rotation device, not shown. The toner is fed by the toner feed roller 3 onto the outer peripheral surface of the developing roller 4. The blade contact unit 8 of the toner restricting member 6 presses the toner T which is deposited on the peripheral surface of the developing roller 4 against the outer periphery of the developing roller 4. By so doing, the blade contact unit 8 forms the toner T as a thin layer on the outer periphery of the developing roller 4 and, at the same time, the toner is triboelectrically charged. The charged toner T is deposited onto the outer periphery of the drum 9 to allow an electrostatic image which is formed on the outer periphery of the drum 9 to be developed into a visible image.

Such a conventional developing device has drawbacks as will be set forth below.

The toner restricting member 6 is of such a type that the contact unit 8 is fixed directly to the leaf spring 7. The leaf spring 7 performs a double function of holding the blade contact unit 8 in place and bringing the blade contact unit 8 in contact with the developing roller 4 by its spring force. However, the force by which the leaf spring 7 directly acts upon the blade contact unit 8 varies, thus varying the state in which the blade contact unit 8 makes contact with the developing roller 4.

That is, the leaf spring 7 has substantially the same length as that of the developing roller 4 and, because it is provided in a restricted space, is slender in configuration. For this reason, the spring constant is set to a large value so as to obtain a predetermined spring force. If, however, the spring constant of the leaf spring 7 is set to a large value, then the pressure force with which the blade contact unit 8 is pressed by the leaf spring 7 against the developing roller 4 varies greatly in accordance with the wear of the blade contact unit 8 caused by frictional contact with the developing roller 4.

Further, the leaf spring 7, being longer in its lateral direction, is liable to be deformed in its longitudinal direction, thus causing a local variation of the pressure force with which the blade contact unit 8 is pressed by the leaf spring 7 against the developing roller 4.

The force with and position in which the contact unit 8 is contacted by the developing roller 4 depend heavily upon the thickness of the toner layer on the developing roller 4 and amount of toner charged on the roller. The spring force of the leaf spring 7, being largely varied, causes a larger variation in the thickness of the toner layer on the developing roller 4 and in the amount of toner charged thereon. Therefore, an image of poor quality is formed on the recording sheet, thus failing to obtain a better-quality image.

Further, the spring 7 is manufactured by a discharge machining method and hence involves more manufacturing cost.

SUMMARY OF THE INVENTION

A first object of the present invention is to provide a developing device for an electrophotographic apparatus which ensures a highly reliable developing operation through stable contact between its contact unit and developing roller.

A second object of the present invention is to provide a developing device for an electrophotographic apparatus which can use one toner restricting member over a prolonged period of time rather than a plurality of toner restricting members and, in this sense, is of economic advantage.

In one aspect of the present invention, there is provided a developing device comprising:

a movable toner carrier having its surface deposited with a toner; and a toner restricting member arranged parallel to the toner carrier, the toner restricting member comprising a retaining rod made of a rigid substance and a contact unit, the contact unit being made of an elastic material, provided on an outer periphery of the retaining rod, extending along an axis of the retaining rod and having one contact area whose forward end can be set in contact with the surface of the toner carrier.

In another aspect of the present invention, there is provided a developing device comprising:

a movable toner carrier having its surface deposited with a toner; and a toner restricting member arranged parallel to the toner carrier, the toner restricting member comprising a retaining rod made of a rigid substance and a contact unit, the contact unit made of an elastic material, provided on an outer periphery of the retaining rod, extending along an axial direction of the retaining rod and having a plurality of contact areas arranged along the outer periphery of the retaining rod and whose ends can be set in contact with the surface of the toner carrier one at a time.

In still another aspect of the present invention there is provided a method for setting a toner restricting member in place on a developing device, comprising the steps of:

(1) preparing a toner restricting member comprising a retaining rod made of a rigid substance and a contact unit, made of an elastic material, fixed on an outer surface of the retaining rod, extending along an axial direction of the retaining rod and having at least one contact area; and (2) locating the toner restricting member in a parallel relation to a toner carrier and setting the contact area in contact with a surface of the toner carrier.

According to the present invention, the rigid substance ca be used for the blade retaining rod and the blade can be held in a stable way so that the blade can be stably set in contact with the toner carrier.

Further, it is possible to obtain a highly accurate toner restricting member using a combination of the retaining rod and contact unit of high dimensional accuracy and to obtain an image of excellent quality.

Since the toner restricting member has a plurality of contact areas, it can be used over an extended period of time by switching from one contact area to another in accordance with the extent of the latter's wear. The toner restricting member using such a single specific contact unit as already set out above is economically more efficient than the plurality of toner restricting members each equipped with a single contact unit which would have to be used to achieve the same advantage as that of the present invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A developing device according to a first embodiment of the present invention will be explained below.

The developing device of the first embodiment is of such a type that a contact unit with one contact area is provided on a retaining rod of a toner restricting member.

Figure 1:
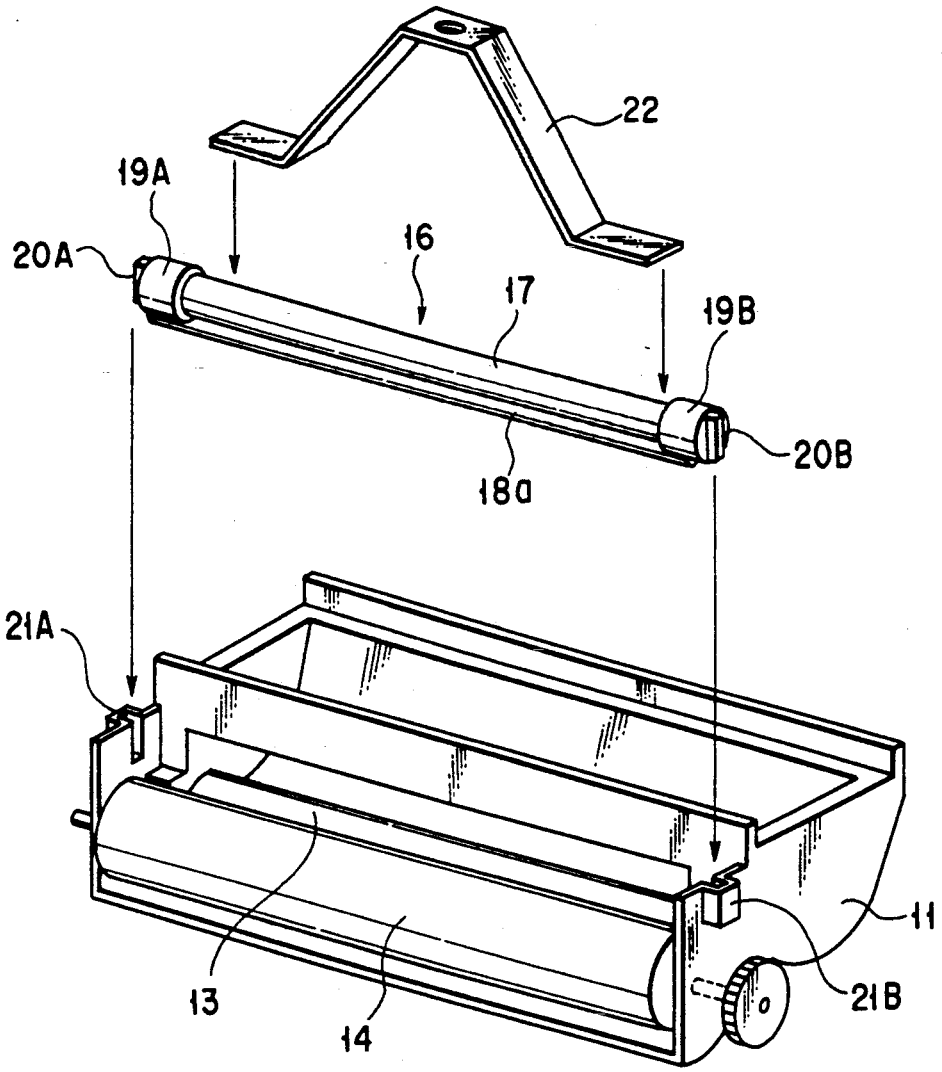
FIG. 1 is an expanded, perspective view showing a developing device according to a first embodiment of the present invention.
Figure 2:
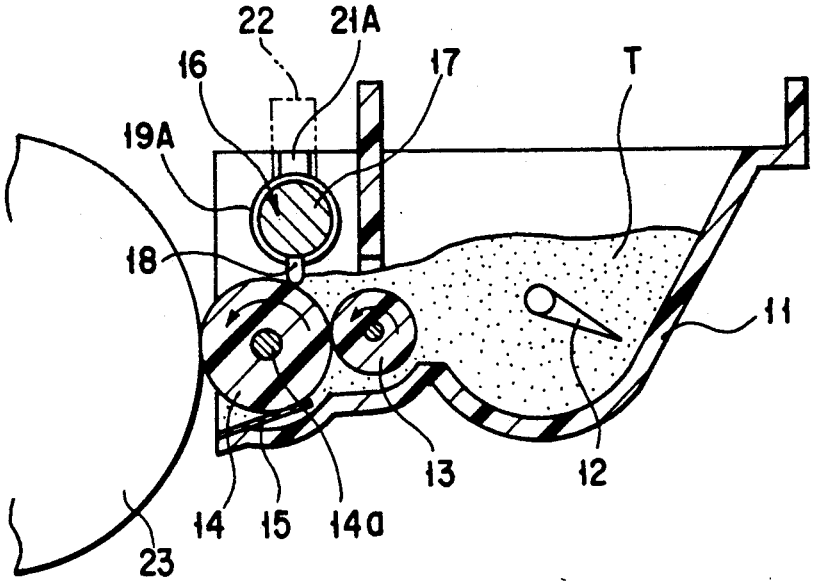
FIG. 2 is a cross-sectional view showing the developing device of FIG. 1.
Figure 3:
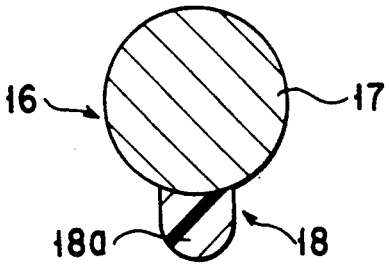
FIG. 3 is a cross-sectional view showing a toner restricting member for the developing device of FIG. 1.

Now the first embodiment of the present invention will be explained below:

In the embodiment shown in FIGS. 1 to 3, a rod of a circular cross-section is employed as a retaining rod of a toner restricting member.

FIGS. 1 and 2 show a diagrammatic view showing a developing device.

The developing device is located parallel to a photosensitive drum (image carrier) 23 provided in a body of an electrophotographic apparatus.

The developing device comprises a casing 11, agitator 12, toner feed roller 13, developing roller (toner carrier) 14, collection blade 15 and toner restricting member 16.

The casing 11 has substantially the same length as that of the photosensitive drum 23 and defines a space where a nonmagnetic toner T not containing any carrier is stored and where the agitator 12 is located. An opening is provided at that area facing the photosensitive drum 23 where the toner feed roller 13 and developing roller 14 are located. The casing 11 is provided parallel to the photosensitive drum 23.

The toner feed roller 3 and developing roller 14 have substantially the same length as that of the photosensitive drum 23. The developing roller 14 is an electroconductive roller and is fixed to the outer periphery of a metal shaft 14*a*. The toner feed roller 13 and developing roller 14 are located parallel to the drum 23 such that these rollers are rotatably supported. The developing roller 14 is located at an outer side of the casing 11 relative to the toner feed roller 13 such that the roller 14 is set in contact with the outer periphery of the drum 23.

The collection blade 15 is mounted on the casing 11 at an area below the developing roller 14 and set in contact with the developing roller 14 so that a toner T does not leak from between the developing roller 14 and the casing 11.

The toner restricting member 16 has a retaining rod 17 and contact unit 18 as shown in FIG. 3. The retaining rod 17 has substantially the same length as that of the photosensitive drum 23, is made of a rigid substance, that is, a metal such as carbon steel and stainless steel, and is comprised of a rod whose cross-section is circular. The metal rod is manufactured by a cold-drawing method.

The contact unit 18 is warhead like in cross-section, that is, of a blade like configuration, and has the same length as that of the retaining rod 17. The contact unit 18 is made of an elastic material, such as insulating rubber. The contact unit 18 is provided on the portion of a outer periphery of the retaining rod 17 and extends in the longitudinal direction of the retaining rod 17. The base end of the contact unit 18 is abutted against the outer periphery of the retaining rod 17 and thermocompression bonded to the retaining rod. The distal end of the contact unit 18 serves as a contact area 18*a* contacting the outer periphery of the developing roller 14. Therefore the contact unit 18 has a single contact area 18*a*. The contact area 18*a* of the contact unit 18 extends from the retaining rod 17 to a height smaller than a diameter of the retaining rod 17 to a height smaller than a diameter of the retaining rod.

The toner restricting member 16 is situated above the developing roller 14 and extends in a direction parallel to the photosensitive drum 23 with its contact unit facing downwardly as shown in FIG. 1.

Both the ends of the retaining rod 17 are so supported on the opposed walls of the casing 11 as to be displaceable in an up/down direction but not in a rotational direction. That is, caps 19A and 19B are fitted over the corresponding ends of the retaining rod 17 as shown in FIG. 1. Each cap 19A, 19B has a circular configuration corresponding to the end portion of the retaining rod (round rod) 17 with a cutout provided to allow the cap to be fitted over the end of the retaining rod 17. Vertically extending, straight ribs 20A and 20B are provided at both outer ends of the caps 19A and 19B, respectively, the ribs extending in an up/down direction.

A pair of vertically extending grooves 21A, 21B are provided in the opposed walls of the casing 11 and are opened at the upper edges of the opposed walls of the casing 11.

The straight ribs 20A and 20B of the caps 19A and 19B (fitted over the ends of the retaining rod 17) are inserted into the associated grooves 21A and 21B of the casing 11 so that the retaining rod 17 is movably, but nonrotatably, supported by the casing 11. In this state, the contact area 18*a* of the contact unit 18 is placed, under an elastic force of the contact unit 18 by itself, on the outer periphery of the developing roller 14. When the retaining rod 17 is depressed by a spring 22 from above, then the retaining rod 17 is stably supported to allow the contact unit 18 to be placed in stable contact with the outer periphery of the developing roller 14.

The operation of the developing device is as follows:

A nonmagnetic toner T in a toner storage section of the casing 11 is fed onto the toner feed roller 13 by the rotation of the agitator 12. The toner feed roller 13 and developing roller 14 are rotated by a rotation device, not shown. The toner T is deposited by the toner feed roller 13 onto the outer periphery of the developing roller 14.

The toner T on the outer periphery of the developing roller 14, upon being passed through the contact unit 18 of the toner restricting member 16, is pressed by the contact area 18*a* of the contact unit 18 against the outer periphery of the developing roller 14. By so doing, the toner T is deposited as a thin layer on the outer periphery of the developing roller 14 while, at the same time, being triboelectrically charged. Further, the toner T is deposited onto the outer periphery of the photosensitive drum 23.

In the developing device, since the toner restricting member 16 includes the retaining rod 17, composed of a rigid substance, and the contact unit 18, composed of rubber, fixed to the retaining rod 17 and constituting a portion of the outer periphery of the toner restricting member an advantage is obtained as will be set out below.

The retaining rod, being made of a rigid substance, is less likely to be deformed in the axial direction upon reception of any external force, thus allowing the contact area 18*a* of the contact unit 18 to stably contact the outer periphery of the developing roller 14 axially along the developing roller.

When the retaining rod 17 is depressed by the spring 22, then a spring force is borne by the retaining rod 17 and does not act upon the contact unit 18 directly. For this reason, the spring 22 for depressing the retaining rod 17 ensures an allowable specification without being restricted by the magnitude of the spring constant. Thus, there is no possibility that a contact force of the contact unit 18 on the developing roller 14 will vary in accordance with the extent of wear caused by the slide contact of the contact unit 18 with the developing roller 14.

As a result, the thickness of the toner layer on the developing roller 14, as well as the amount of toner charged on the surface of the developing roller, can be stabilized to obtain a stable image of better quality.

In the embodiment shown, as the retaining rod 17 is made of a rigid substance, such as metal, no larger warp occurs upon the manufacture of the retaining rod 17 and it is possible to manufacture the retaining rod 17 with high dimensional accuracy. It is, therefore, not necessary to straighten out the retaining device with a straightening device.

Further, the contact unit 18 is not warped even if it was thermocompression bonded to the retaining rod 17. It is thus possible to prevent an increase in the number of manufacturing steps required and in the manufacturing cost.

When the toner feed roller 13 feeds the toner T to the developing roller 14, any excessive toner not passed through the contact unit 18 is readily moved along the outer periphery of the retaining rod 17 and readily back into the toner storage section of the casing 11. It is thus possible to prevent accumulation and aggregation of the toner T at an area between the retaining rod 17 and the developing roller 14 and to form the toner T as a thin film without causing any inconvenience.

The retaining rod 17 and contact unit 18 of the toner restricting member 16 are not restricted to those set out above and can be changed or modified without departing from the spirit and scope of the present invention.

Those toner restricting members 16 as shown in FIGS. 4 to 7 are each made of, for example, metal and have a retaining rod 17 circular in cross-section.

Figure 4:
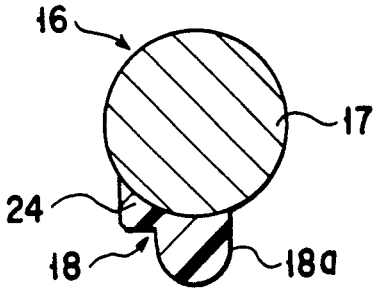
FIG. 4 is a cross-sectional view showing a toner restricting member using a retaining rod formed of a round bar.

The toner restricting member 16 as shown in FIG. 4 has a structure as will be set out below. A contact unit 18 is formed of an elastic member and has a contact area 18*a* and base seat 24. The base seat 24 has the same length as that of the contact area 18*a* and a width greater than that of the contact area 18*a*. The contact area 18*a* is projected from the base seat 24 such that the contact area 18*a* is integral with the base seat 24. The base seat 24 is provided at the base of the contact area 18*a* in which case the base seat 24 projects on the downstream side of the contact area, as viewed in the toner conveying direction, that is, in the rotation direction of the developing roller 14, with the contact area 18*a* as a reference. The base seat 24 is thermocompression bonded to the outer periphery of the retaining rod 17.

In this structure, the contact area 18 can obtain a greater fixing area relative to the retaining rod 17 than a contact area provided without a base seat. It is thus possible to increase the bond strength with which the contact unit 18 is fixed to the retaining rod 17. Upon the formation of the base seat 24, a resin injection opening can be provided at the projected area, thus eliminating the need to provide a resin injection opening at the distal end portion of the contact area 18*a*, that is, at the developing roller contacting area. As a result, the distal end portion of the contact area 18*a* becomes smoother. Since the contact unit 18 has, unlike the base seat 24, no projected area on the upstream side of the developing roller as viewed in the direction of the feed of the toner T, the toner flows smoothly without being lodged at that area defined between the contact unit 18 and the developing roller 14.

Figure 5:
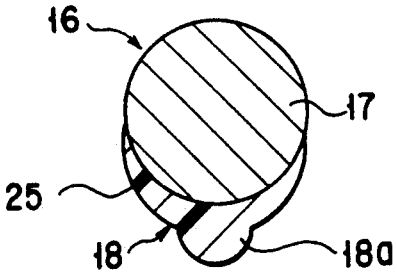
FIG. 5 is a cross sectional view showing a toner restricting member using a retaining rod formed of a round bar.

The toner restricting member 16 as shown in FIG. 5 has a structure as will be set out below. A contact unit 18 has a contact area 18*a* and a base seat 25 on which the contact area 18*a* is provided. The base seat 25 is projected at both the upstream and downstream sides of the contact area 18*a* (with the contact area as a reference) as viewed in the direction of the feed of toner. This structure, like the structure as shown in FIG. 4, has an advantage from the standpoint of its strength and its formation.

Figure 6:
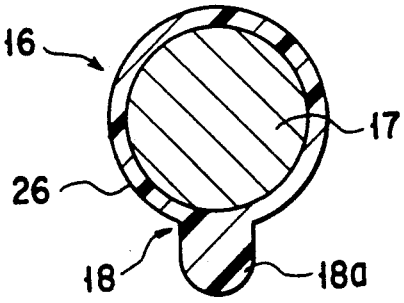
FIG. 6 is a cross-sectional view showing a toner restricting member using a retaining rod formed of a round bar.

The toner restricting member 16 as shown in FIG. 6 has the following structure. A contact unit 18 has a contact area 18*a* and a base seat 26. The base seat is annular in cross-section and has an inner diameter and length the same as the diameter and length of the retaining rod 17. The contact area 18*a* is provided on a portion of an outer periphery of the base seat 26 along the full length of the base seat 26. The base seat 26 is fitted over the outer periphery of the retaining rod 17 along the full length of the latter. This arrangement can fix the contact unit 18 to the retaining rod 17 with a greater strength.

Figure 7:
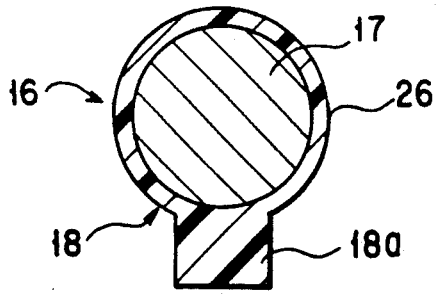
FIG. 7 is a cross sectional view showing a toner restricting member using a retaining rod formed of a round bar.

A toner restricting member 16 as shown in FIG. 7 is a variant of the toner restricting member 16 as shown in FIG. 6. The toner restricting member 16 shown in FIG. 7 has a contact area 18*a* whose distal end is flattened and can more stably contact the outer periphery of the photosensitive drum 23 than the contact area whose distal end is round.

FIGS. 8 to 11, each, show a toner restricting member 16 having a retaining rod 27 comprised of a cylinder whose cross section is annular. The toner restricting member 16, having a retaining rod 27 of such an annular configuration, can be made lighter in weight.

Figure 8:
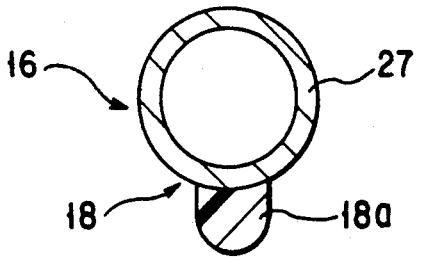
FIG. 8 is a cross-sectional view showing a toner restricting member using a retaining rod formed of an annular.

In a toner restricting member 16 shown in FIG. 8, a contact unit 18 is fixed directly to a retaining rod 27 and has only a contact area 18*a* thereon as in the case of the toner restricting member 16 shown in FIG. 3.

Figure 9:
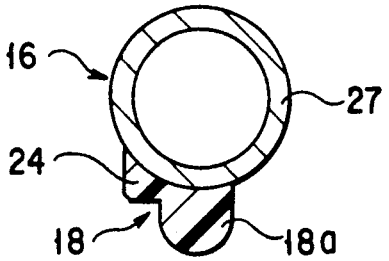
FIG. 9 is a cross-sectional view showing a toner restricting member using a retaining rod formed of an annular bar.

In a toner restricting member 16 shown in FIG. 9, a contact unit 18 is fixed to a retaining rod 27 and has a contact area 18*a* and base seat 24 as in the case of the toner restricting member 16 shown in FIG. 4.

Figure 10:
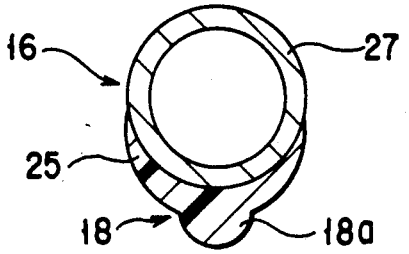
FIG. 10 is a cross-sectional view showing a toner restricting member using a retaining rod formed of an annular bar.

In a toner restricting member 16 shown in FIG. 10, a contact unit 18 is fixed to a retaining rod 27 and has a contact area 18*a* and base seat 25 as in the case of the toner restricting member 16 shown in FIG. 5.

Figure 11:
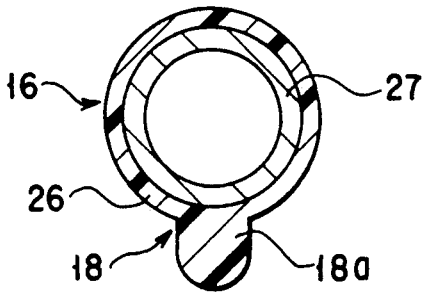
FIG. 11 is a cross-sectional view showing a toner restricting member using a retaining rod formed of an annular bar.

In a toner restricting member 16 shown in FIG. 11, a contact unit 18 is fixed to a retaining rod 27 and has a contact area 18*a* and base seat 26 as in the case of the toner restricting member 16 shown in FIG. 6.

Toner restricting members 16 shown in FIGS. 12 to 15, each, use a retaining rod 28 having a square cross-section.

Figure 12:
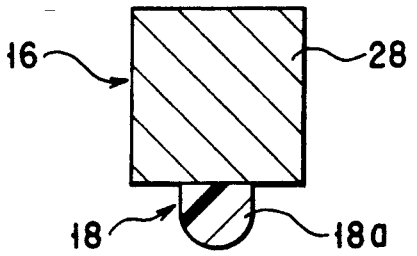
FIG. 12 is a cross sectional view showing a toner restricting member using a retaining rod formed of a square bar.

In the toner restricting member 16 shown in FIG. 12, a contact unit 18 is fixed directly to the retaining rod 28 and has only a contact area 18*a* thereon as in the case of the toner restricting member 16 shown in FIG. 3.

Figure 13:
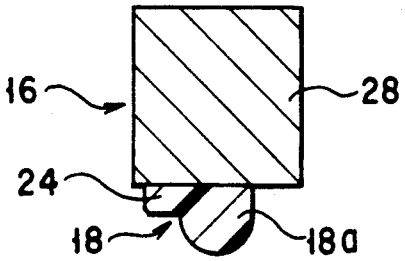
FIG. 13 is a cross-sectional view showing a toner restricting member using a retaining rod formed of a square bar.

In the toner restricting member 16 shown in FIG. 13, a contact unit 18 is fixed to the retaining rod 28 and has a contact area 18*a* and base seat 24 as in the case of the toner restricting member 16 as shown in FIG. 4.

Figure 14:
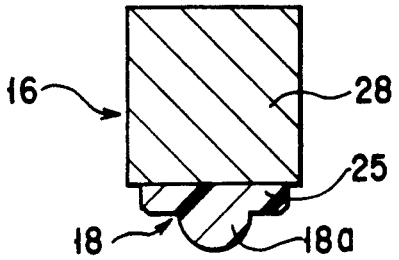
FIG. 14 is a cross sectional view showing a toner restricting member using a retaining rod formed of a square bar.

In a toner restricting member 16 shown in FIG. 14, a contact unit 18 is fixed to the retaining rod 28 and has a contact area 18*a* and base seat 25 as in the case of the toner restricting member 16 shown in FIG. 5.

Figure 15:
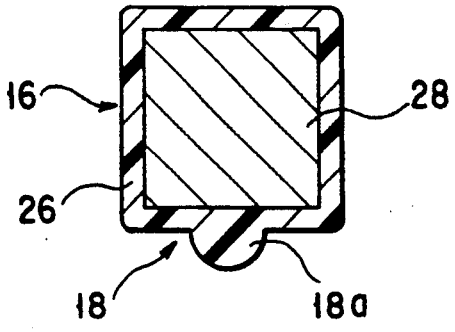
FIG. 15 is a cross-sectional view showing a toner restricting member using a retaining rod formed of a square bar.

In a toner restricting member shown in FIG. 15, a contact unit 18 is fixed to the retaining rod 28 and has a contact area 18*a* and base seat 26 as in the case of the toner restricting member 16 shown in FIG. 6.

Toner restricting members 16 shown in FIGS. 16 to 19, each, use a retaining rod 29 having a hollow square cross-section.

Figure 16:
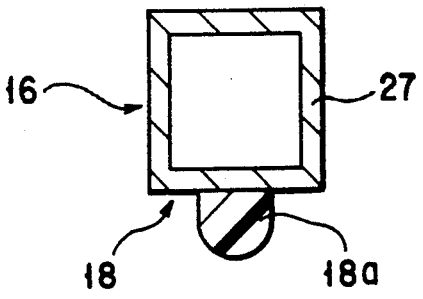
FIG. 16 is a cross-sectional view showing a toner restricting member using a retaining rod formed of a hollow square bar.

In the toner restricting member 16 shown in FIG. 16, a contact unit 18 is fixed directly to the retaining rod 29 and has only a contact area 18*a* thereon as in the case of the toner restricting member 16 shown in FIG. 3.

Figure 17:
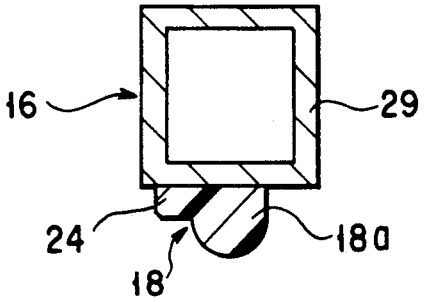
FIG. 17 is a cross-sectional view showing a toner restricting member using a retaining rod formed of a hollow square bar.

In the toner restricting member 16 shown in FIG. 17, a contact unit 18 is fixed to the retaining rod 29 and has a contact area 18*a* and base seat 24 as in the case of the toner restricting member 16 shown in FIG. 4.

Figure 18:
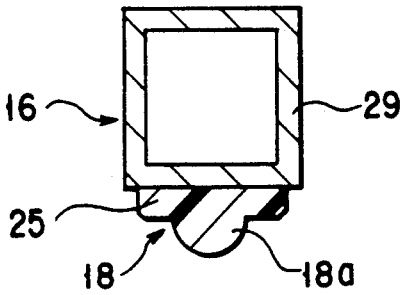
FIG. 18 is a cross-sectional view showing a toner restricting member using a retaining rod formed of a hollow square bar.

In the toner restricting member 16 shown in FIG. 18, a contact unit 18 is fixed to the retaining rod 29 and has a contact area 18*a* and base seat 25 as in the case of the toner restricting member 16 shown in FIG. 5.

Figure 19:
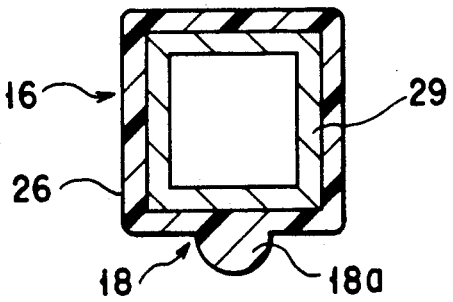
FIG. 19 is a cross-sectional view showing a toner restricting member using a retaining rod formed of hollow square bar.

In the toner restricting member 16 shown in FIG. 19, a contact unit 18 is fixed to the retaining rod 29 and has a contact area 18*a* and base seat 26 as in the case of the toner restricting member 16 shown in FIG. 6.

The retaining rod of the toner restricting member 16 can be made of not only metal but also a rigid synthetic resin and the contact unit can be made of not only rubber but also other elastic materials.

A means for supporting the retaining rod of the toner restricting member is not restricted to the one set out above.

A developing device according to a second embodiment of the present invention will be explained below.

In the developing device of the second embodiment, one contact unit is provided at a retaining rod of a toner restricting member and has a plurality of contact areas.

The second embodiment will be explained below with reference to FIGS. 20 to 22.

In the second embodiment, a rod circular in cross-section is provided as a retaining rod for the toner restricting member.

Figure 20:
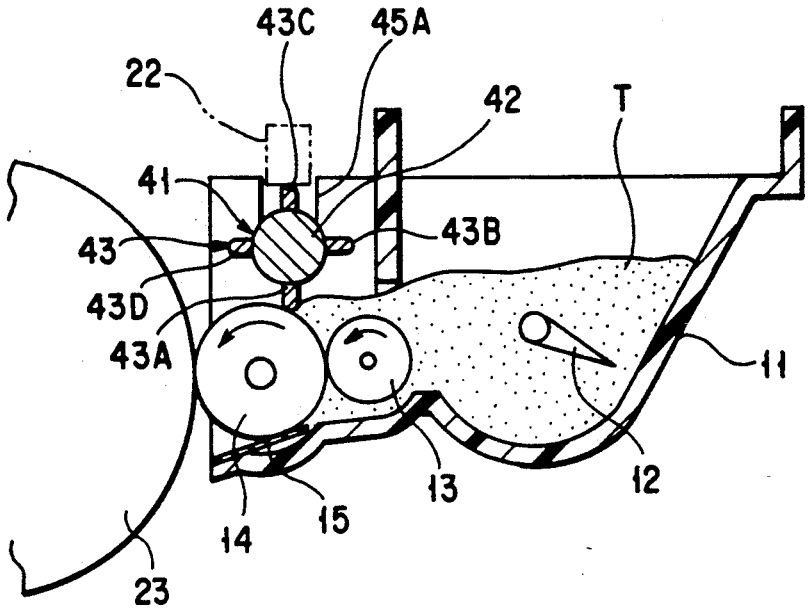
FIG. 20 is a cross sectional view showing a developing device according to a second embodiment of the present invention.
Figure 21:
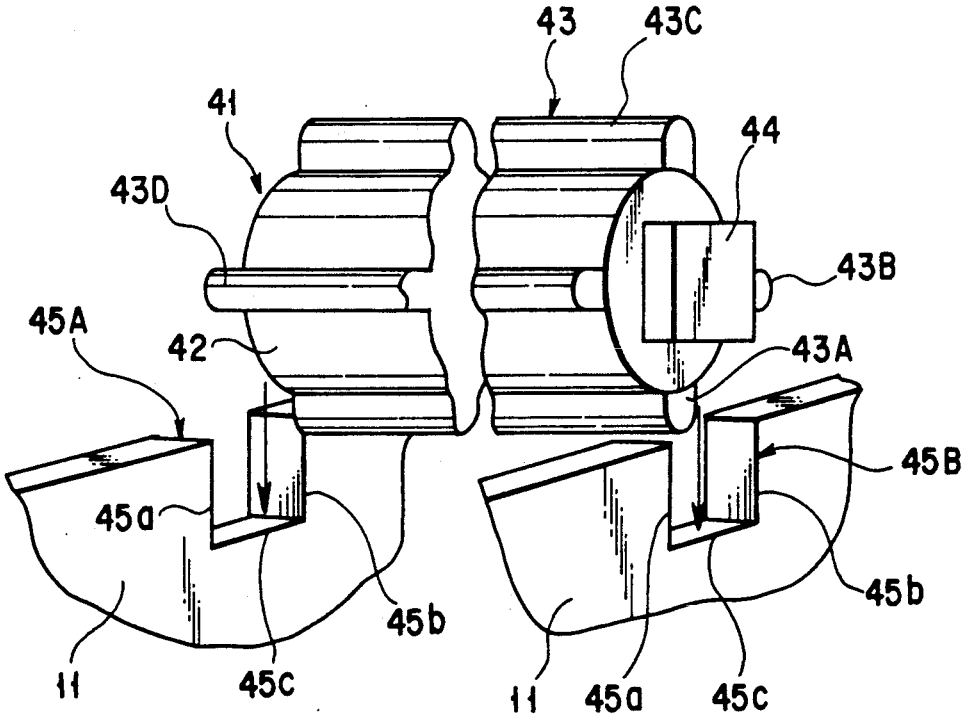
FIG. 21 is a perspective view showing the toner restricting member of the device of FIG. 20.

FIGS. 20 and 21 show a diagrammatic arrangement of the developing device.

The developing device of FIGS. 20 and 21 are of a nonmagnetic one component developing type. The developing device is the same as that shown in FIGS. 1 and 2 except for the toner restricting member and its support structure. The same reference numerals are employed in the second embodiment to designate component parts or elements corresponding to those shown in FIG. 2. That is, reference numeral 11 shows a casing; 12, an agitator; 13, a toner feed roller; 14, a developing roller; 15, a collection blade; 22, a leaf spring; and 23, a photosensitive drum.

In FIG. 20, reference numeral 41 shows a toner restricting member having a retaining rod 42 and contact unit 43. The retaining rod 42 is made of a rigid substance, such as carbon steel and stainless steel. The retaining rod 42 has a length greater than the photosensitive drum 23. The contact unit 43 has, for example, four contact areas 43A, 43B, 43C, and 43D which are mutually separated from each other. The contact areas 43A, 43B, 43C and 43D are made of an elastic material, such as insulating rubber, and are of a blade type and have the same length as that of the retaining rod 42 as in the case of the contact area 18*a* of the contact unit 18 in the first embodiment of the present invention. The contact area 43A, 43B, 43C and 43D are fixedly bonded on the outer periphery of the retaining rod 42 such that these contact areas are located at circumferentially equal intervals and extend axially along the retaining rod 42. Each of the contact areas 43A, 43B, 43C and 43D of the contact unit 43 extends from the retaining rod 42 to a height smaller than a diameter of the retaining rod.

A pair of right square members 44, 44 are mounted one at each end of the retaining rod 42 and are adapted to position the contact areas 43A, 43B, 43C and 43D constituting the contact unit 43. The number of corners of the right square members is set to be equal to that of the contact areas 43A, 43B, 43C and 43D of the contact unit 43. The four sides of the right square member 44 correspond in position to the respective contact areas 43A, 43B, 43C and 43D. For example, externally threaded sections of the right square members 44 are inserted, in an aligned relation, into internally threaded portions of the opposed end portions of the retaining rod 42 at and along the center axis of the latter.

A pair of support sections 45A, 46B are oppositely formed in those right and left side walls of the casing 11 so as to locate the toner restricting member 41. The respective support sections 45A and 45B are formed as corresponding square openings in the casing 11 so as to fixedly support the right square members 44 on both the ends of the retaining rods 42 of the toner restricting member 41. That is, the respective support sections 45A and 45B are opened at the upper edges of the opposed side walls of the causing 11 so as to detachably insert the corresponding square members 44. In this connection it is to be noted that the support sections 45A and 45B, each, have a pair of opposed sides 45*a*, 45*b* corresponding to the vertically opposed sides of the right square member 44 and a bottom side 45*c* on which the lower side of the square member 44 is seated.

The square members 44 on the retaining rod 42 are fitted from above into the support sections 45A and 45B of the casing 11 and supported there in which case each square member 44 has opposed sides set vertically.

Figure 22A:
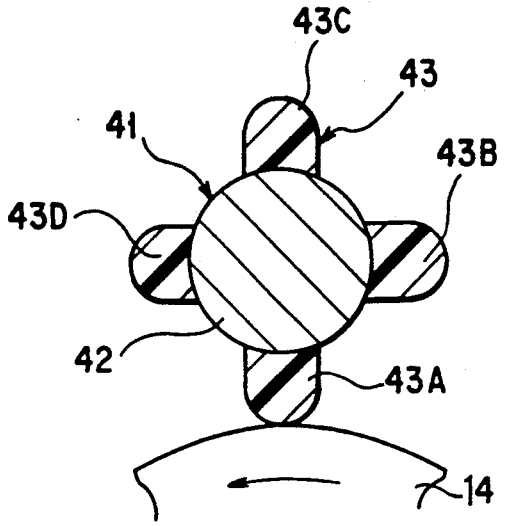
FIG. 22A shows a toner restricting member whose position is switched to another position for setting.
Figure 22B:
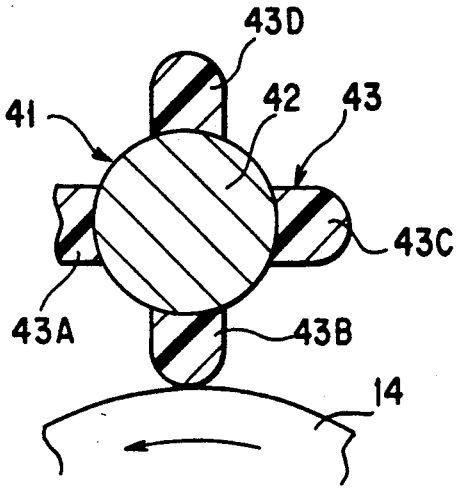
FIG. 22B shows a toner restricting member whose position is switched to another position for setting.

The opposed sides of each square member 44 are vertically fitted in that opening defined by the opposed sides 45*a*, 45*b* and bottom side 45*c* of each support section so that the retaining rod 42 is fixed in place, that is, not rotated along its axis. Of those contact areas 43A, 43B, 43C and 43D of the contact unit 43 as shown in FIG. 22A, the lowest one as shown in FIG. 22B is set in contact with the outer periphery of the developing roller 14.

The topmost contact area 43C for example of the retaining rod 22 is depressed by a leaf spring 22 as shown in FIG. 20. The leaf spring 22 is attached to a member, not shown, and, by so doing, the toner restricting member 41 is supported in a stable way.

The developing operation of the developing device thus arranged will be carried out as follows:

The contact area 43A of the toner restricting member 41 is set in contact with the outer periphery of the developing roller 14 as shown in FIG. 20, allowing toner T which is deposited on the developing roller 14 to be pressed against the outer periphery of the developing roller 14. By so doing, the toner T is formed as a thin layer on the outer periphery of the developing roller 14 and triboelectrically charged there at that time. In this case, a rotational force is applied by the contact area 43A. Since, therefore, the retaining rod 42 is fixed in place, by each square member, in each support section 45A, 45B of the casing 11, the retaining rod 42 is not rotated.

The contact area 43A in contact with the developing roller 14 is worn by its sliding contact with the rotating developing roller 14. If a thin toner layer is hard to form on the outer periphery of the developing roller 14 due to a progressed wear of the contact area 43A, the retaining rod 42 is detached away from the support sections 45 and 45B. The retaining rod 42 is rotated through an angle of 90° about along its axis so that the contact area 43B faces the developing roller 14 in place of the contact area 43A. In this state, the retaining rod 42 is again set in the support sections 45A and 45B of the casing 11 so that the new contact area 42B is placed in contact with the outer periphery of the developing roller 4 as shown in FIG. 22B.

In this way, the contact areas 43A, 43B, and 43C and 43D are set in contact with the developing roller 14 in a way that each is replaced with another contact area in accordance with an extent of its wear, that is, all the four contact areas 43A, 43B, 43C and 43D can be used, one at a time, for contact with the developing roller. It is thus possible to extend the life of the contact unit 43 a few times longer than that of a conventional contact unit.

The structure of the retaining rod and contact unit of the toner restricting member 41 is not restricted to those of the aforementioned embodiments and various changes or modifications of the present invention can be made without departing from the spirit and scope of the present invention.

Another form of the toner restricting member 41 will be explained below.

Those toner restricting members shown in FIGS. 23 to 27 use a retaining rod 42 circular in cross-section.

Figure 23:
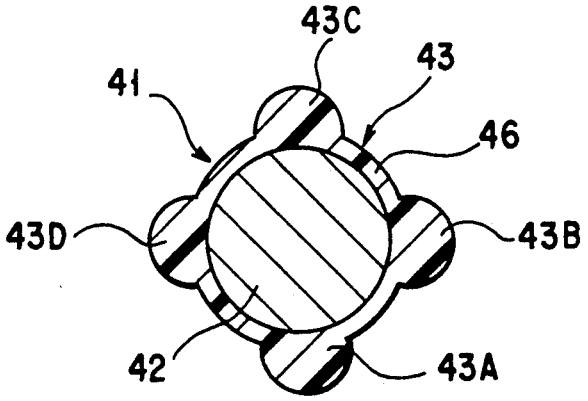
FIG. 23 is a cross-sectional view showing a toner restricting member using a retaining rod formed of a round bar.

The toner restricting member 41 shown in FIG. 23 shows an improved version of the toner restricting member 41 shown in FIG. 22. The contact unit 43 in FIG. 23 has respective contact areas 43A, 43B, 43C and 43D and base seat 46 cylindrical in configuration. The contact areas 43A, 43B, 43C and 43D are fixedly bonded on the outer periphery of the retaining rod 41 such that these contact areas are arranged at and along the outer periphery of the base seat 46.

Figure 24:
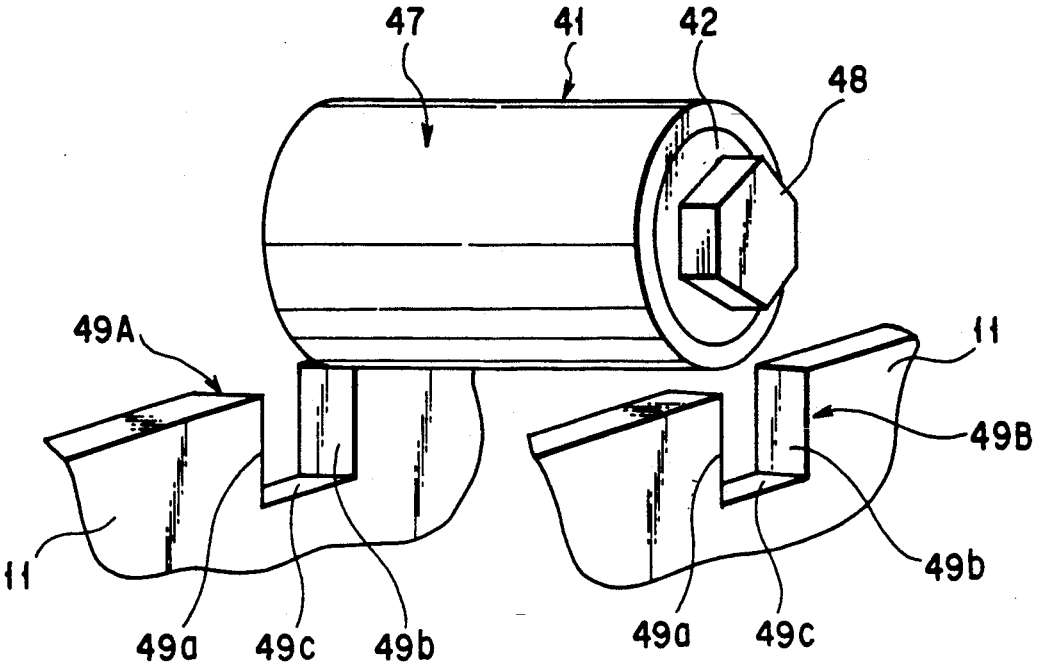
FIG. 24 is a perspective view showing a toner restricting member using a retaining rod formed of a round bar.
Figure 25:
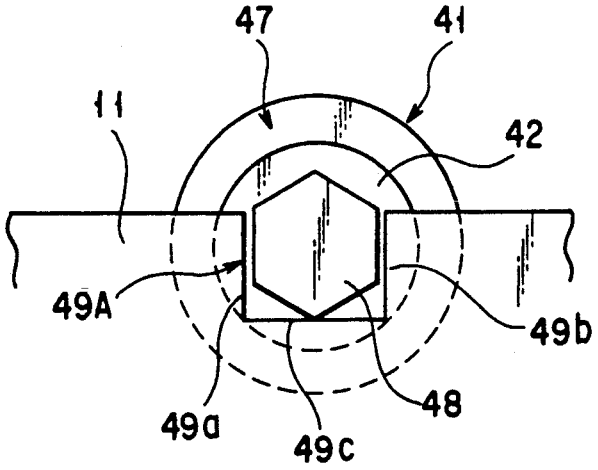
FIG. 25 is a side view showing the toner restricting member of FIG. 24.

The toner restricting member 41 as shown in FIGS. 24 to 26 will be explained below.

In FIGS. 24 to 26 the same reference numerals are employed to designated parts or elements corresponding to those shown in FIGS. 20 and 21.

In FIGS. 24 to 26, a cylindrical contact unit 47 is fitted over an outer periphery of a retaining rod (round rod) 42 in which case the contact unit 47 is formed into a cylindrical continuous configuration instead of forming those contact areas 43A, 43B, 43C and 43D separately on a contact unit 43. A pair of right hexagonal members 48, 48 are mounted one at each end of the retaining rod 42 such that these hexagonal members are fixed to the retaining rod 42 in the same method as the combination of the right square members 44 and retaining rod 42 shown in FIGS. 20 and 21.

A pair of support sections 49A, 49B are provided one at each upper side edge of casing 11 so as to sup port the retaining rod. The respective support sections 49A and 49B are formed as square holes so as to support both ends of the a pair of right hexagonal members 48, 48 of a toner restricting member 41. These support sections are opened at the upper side edges of the opposed walls of the casing 11 so that the retaining rod 42 is detachably inserted into these support sections. The support sections 49A, 49B are defined by a pair of opposed vertical sides 49*a*, 49*b* corresponding to a respective pair of opposed sides of the hexagonal member 48 and a bottom side 49*c* against which a given edge of the hexagonal member of the retaining rod 42 abuts.

Both ends of the retaining rod 42 are supported by the hexagonal members at the support sections 49A and 49B of the casing 11.

Figure 26A:
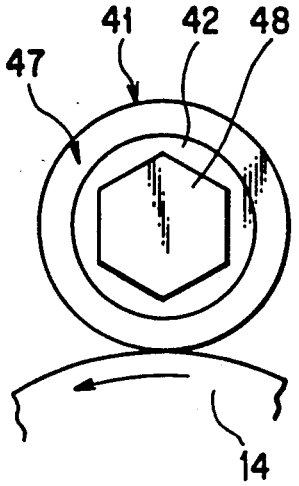
FIG. 26A is a side view showing a toner restricting member whose position is switched to another position for setting.

The retaining rod 42 is supported by the support sections 49A and 49B so that a given pair of opposed sides of each hexagonal member 48 are vertically set relative to the corresponding opposed sides 49*a*, 49*b* of the support sections 49A and 49B. As shown in FIG. 26A, a given pair of sides of the hexagonal members 48 of the retaining rod 42 are vertically set relative to the opposed sides 49*a* and 49*b* of the respective support sections 49A and 49B so that the retaining rod 42 is restricted against axial rotation. By so doing, a corresponding portion of the outer periphery of the contact unit 47 makes contact with the outer periphery of the developing roller 14. Each corresponding portion of the contact unit 47 extends from the retaining rod 42 to a height smaller than a diameter of the retaining rod.

Figure 26B:
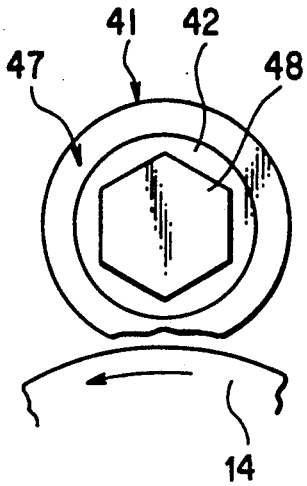
FIG. 26B is a side view showing a toner restricting member whose position is switched to another position for setting.
Figure 26C:
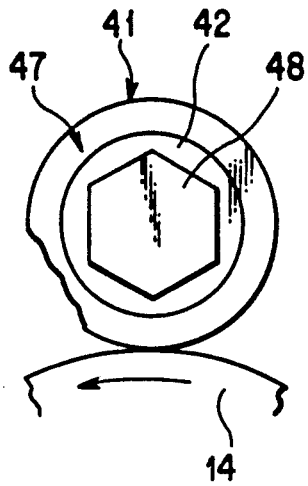
FIG. 26C is a side view showing a toner restricting member whose position is switched to another position for setting.

When the developing operation is done by the developing device, the contact unit is worn due to its sliding contact with the rotating developing roller 14. If it is difficult to form a thin toner layer on the outer peripheral surface of the developing roller 14 due to the progressed wear of the contact unit 47 as shown in FIG. 26B, retaining rod 42 and hence the hexagonal member 48 is detached, as one unit, away from the support sections 49A and 49B of the casing 11. The retaining rod 42 is rotated through an angle of 60° about its axis and then inserted into the support sections of the casing 11. Therefore, as shown in FIG. 26C, another new surface portion of the contact unit 47 is set in contact with the outer periphery of the developing roller 14, and the already worn surface portion of the contact unit 47 is situated away from the developing roller.

In this way, an unworn surface portion of the contact unit 47 can be sequentially used as a contact portion contacting the developing roller 14 so that the whole outer periphery of the contact unit can be utilized as such a contact portion in accordance with an extent of its wear.

Figure 27:
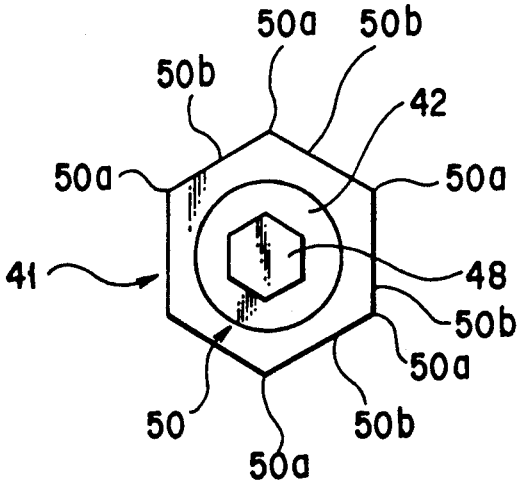
FIG. 27 is a side view showing a toner restricting member using a retaining rod formed of a round bar.

In a toner restricting member 41 as shown in FIG. 27, a contact unit 50 of a right hexagonal cross-section is used instead of the contact unit of a circular cross-section as shown in FIGS. 24 to 26. In this case, each edge 50*a*, or each side 50*b*, of the contact unit 50 is set in contact with the developing roller 14.

In those toner restricting members 41 as shown in FIGS. 28 to 31, use is made of a retaining rod 51 of an annular cross-section. The retaining rod 51, being annular in configuration, can be made lower in weight.

Figure 28:
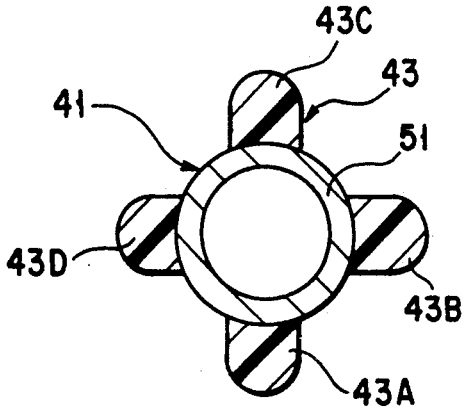
FIG. 28 is a cross-sectional view showing a toner restricting member using a retaining rod formed of an annular bar.

In the toner restricting member 41 as shown in FIG. 28, four contact areas 43A, 43B, 43C and 43D of a contact unit 43 are fixed to the outer periphery of the retaining rod 51 as in the toner restricting member 41 as shown in FIG. 22A.

Figure 29:
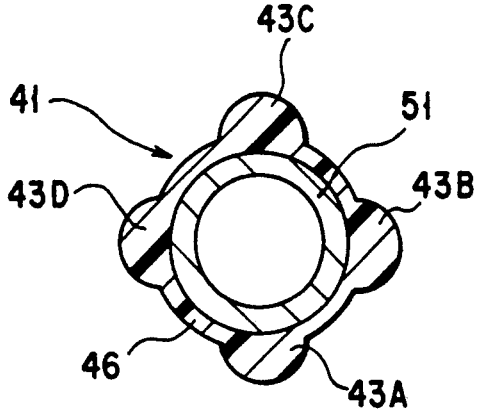
FIG. 29 is a cross-sectional view showing a toner restricting member using a retaining rod formed of an annular bar.

In the toner restricting member 41 as shown in FIG. 29, a contact unit 43 has four contact areas 43A, 43B, 43C and 43D and base seat 46 as shown in FIG. 23, and is fixed to the retaining rod 51 as in the toner restricting member 41 as shown in FIG. 23.

Figure 30:
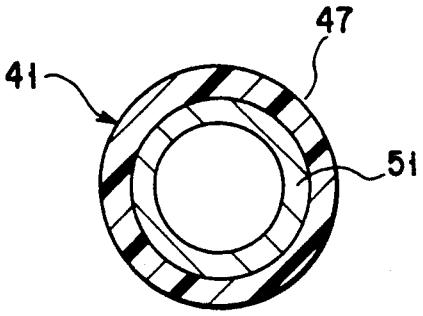
FIG. 30 is a cross-sectional view showing a toner restricting member using a retaining rod formed of an annular bar.

In the toner restricting member 41 as shown in FIG. 30, a contact unit 47 is fitted over the retaining rod 51 as in the retaining rod 51 as shown in FIG. 25.

Figure 31:
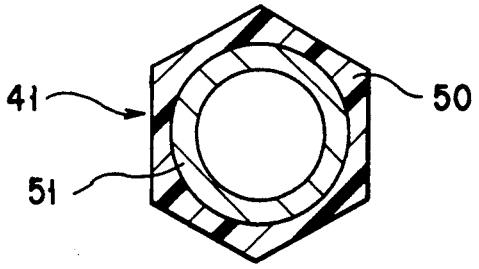
FIG. 31 is a cross-sectional view showing a toner restricting member using a retaining rod formed of an annular bar.

The toner restricting member 41 as shown in FIG. 31 is of such a type that a hexagonal contact unit 50 is fitted over the retaining rod 51 a in the toner restricting member 41 as shown in FIG. 27.

The retaining rod 51 of the toner restricting member 41 as shown in FIGS. 28 to 31 is supported at the casing 11 and restricted against a rotation, but is movable toward and away from the developing roller 14. Square members 44 as shown in FIG. 21 an hexagonal members 48 as shown in FIG. 24 maybe provided on the retaining rod 51 so as to support the retaining rod 51 at the support sections 45A, 45B, or 49A, 49B of the casing 11.

Figure 32:
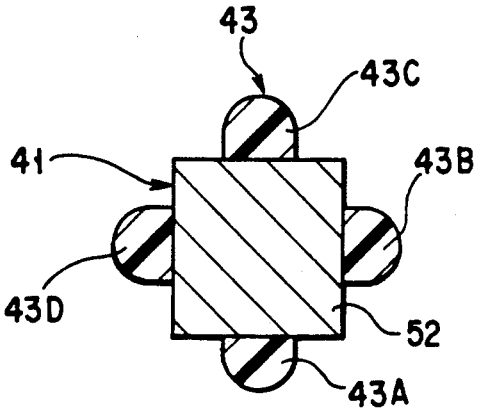
FIG. 32 is a cross-sectional view showing a toner restricting member using a retaining rod formed of a square bar.
Figure 33:
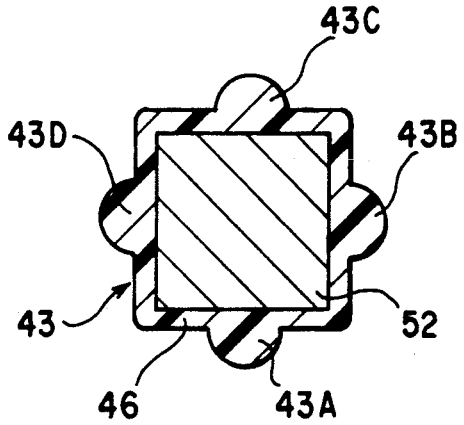
FIG. 33 is a cross-sectional view showing a toner restricting member using a retaining rod formed of a square bar.

The toner restricting members 41 as shown in FIGS. 32 and 33 are of such a type as to have a retaining rod 51 of a right square cross-section.

In the toner restricting member 41 as shown in FIG. 32, a contact unit 43 is formed on the outer surface of the retaining rod 52 and has, for example, mutually separate contact areas 43A, 43B, 43D and 43D as in the toner restricting member 41 as shown in FIG. 22A.

In the toner restricting member 41 as shown in FIG. 33, a contact unit 43 is formed on the retaining rod 52 and has contact areas 43A, 43B, 43C and 43D and base seat 46 as in the toner restricting member 41 as shown in FIG. 23.

Figure 34:
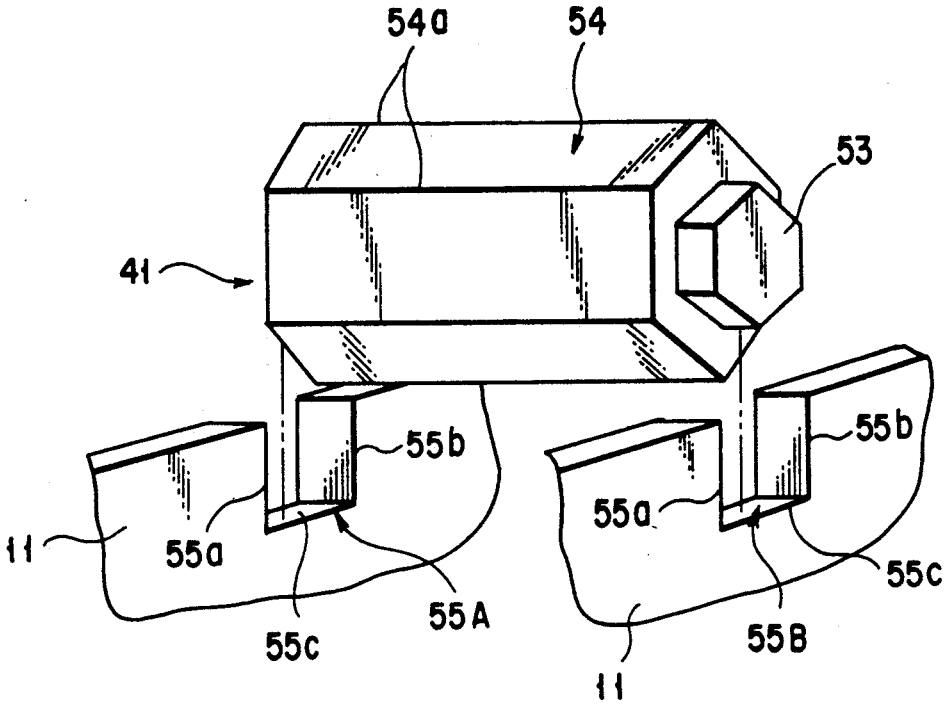
FIG. 34 is a perspective view showing a toner restricting member using a retaining rod formed of a hexagonal bar.
Figure 35:
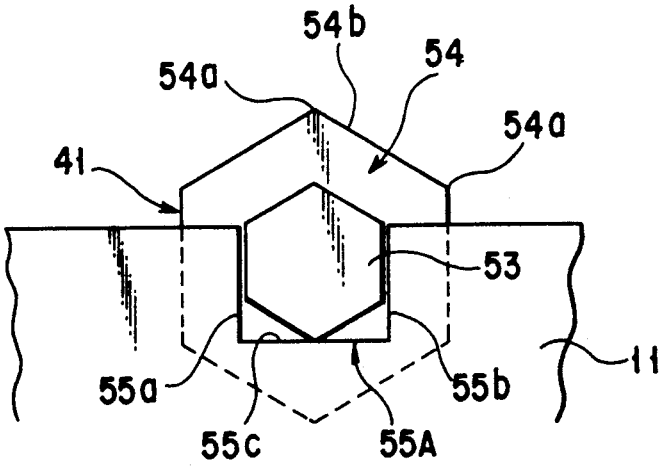
FIG. 35 is a side view showing the toner restricting member of FIG. 34.

Toner retaining member 41 as shown in FIGS. 34 to 36 will be explained below.

The toner restricting member 41 is of such a type that a right-hexagonal contact unit 54 is fitted over a retaining rod 53 of a corresponding right-hexagonal cross-section and bonded there.

Each edge 54*a* of the contact unit 54 can be set in contact with the outer periphery of the developing roller 14. Both the ends of the retaining rod 53 are projected from the contact unit 54 and supported at a pair of support sections 55A and 55B which are formed as openings at the upper edge portions of the casing 11. The combination of the retaining rod 53 and support sections 55A and 55B are used on the same principle as that of the right hexagonal members 48 and support sections 49A and 49B as shown in FIGS. 24 and 25. That is, a pair of opposed sides of the retaining rod 53 are so supported that these sides are vertically set at the opposed sides 55*a*, 55*b* of the support sections 55A, 55B with a bottom edge of the retaining rod 53 supported on a bottom side 55*c* of each support section.

Figure 36A:
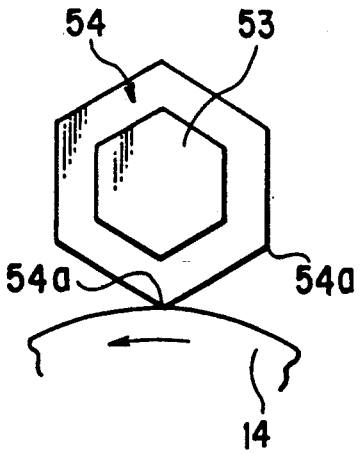
FIG. 36A is a side view showing the toner restricting member whose position is switched to another position for setting.

When the toner restricting member 41 is supported by the casing 11, an edge 54*a*, for example, of the contact unit 54 is set in contact with the developing roller 14 as shown in FIG. 36A.

Figure 36B:
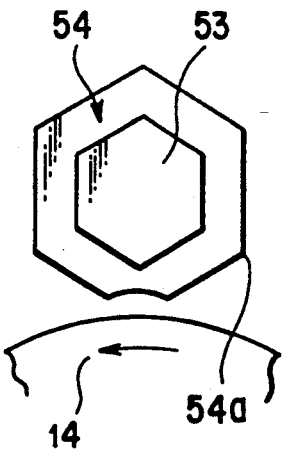
FIG. 36B is a side view showing the toner restricting member whose position is switched to another position for setting.

When the edge 54*a* of the contact unit 54 is worn due to its contact with the developing roller 14 as shown in FIG. 36B, then both the ends of the retaining rod 53 are removed from the support sections 55A, 55B of the casing 11. The retaining rod 53, being rotated through an angle of 60° about its axis, is placed in the support sections 55A, 55B of the casing 11 so that another edge 54a of the contact unit 54 can be set in contact with the developing roller 14.

Figure 36C:
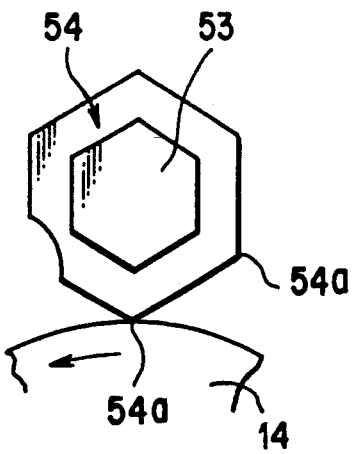
FIG. 36C is views showing the toner restricting member whose position is switched to another position for setting.

In this way, the edge 54a of the contact unit 54 is so re-set in contact with the outer periphery of the developing roller 14 as shown in FIG. 36C. The edges 54a of the contact unit 54 can be sequentially set against the developing roller 14 in accordance with the progressed wear of the contact unit so that all the edges of the contact unit 54 can be employed against to the developing roller.

Although, in this embodiment, the edges 54a of the contact unit 54 can be employed one by one against the developing roller 14, those six sides of the contact unit 54 each defined by the adjacent 54a can also be set in contact with the outer surface of the developing roller 14. Each edge 54a and each side 54b of the contact unit 54 extends from the retaining rod 53 to a height smaller than a diameter of the retaining rod.

Figure 37:
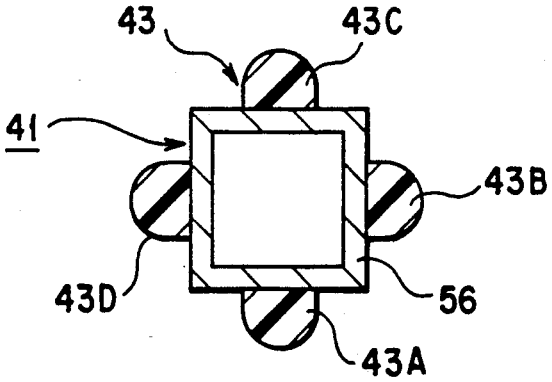
FIG. 37 is a cross-sectional view showing a toner restricting member using a retaining rod formed of a hollow square bar.
Figure 38:
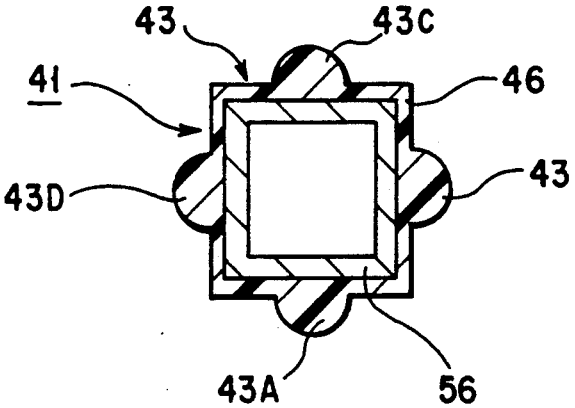
FIG. 38 is a cross-sectional view showing a toner restricting member formed of a hollow square bar.

A toner restricting member 41 as shown in FIGS. 37 and 38 uses a retaining rod 56 having a cross-section with a hollow right square configuration.

In the toner restricting member 41 as shown in FIG. 37, four separate contact areas 43A, 43B, 43C, and 43D are provided on the outer surface of the retaining rod 56 as in the toner restricting member 41 as shown in FIG. 22A.

In the toner restricting member 41 as shown in FIG. 38, a contact unit 43 is formed on the retaining rod 56 and has four contact areas 43A, 43B, 43C and 43D and base seat 46 as in the toner restricting member 41 shown in FIG. 23.

Figure 39:
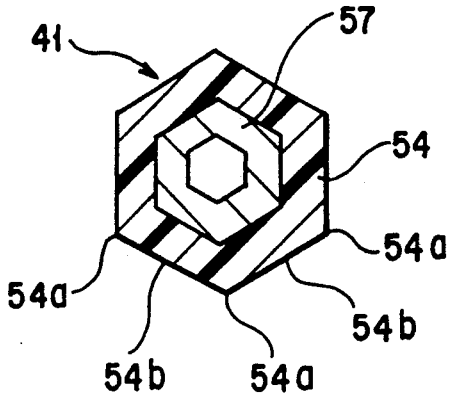
FIG. 39 is a cross sectional view showing a toner restricting member using a retaining rod formed of a hollow hexagonal rod.
Figure 40:
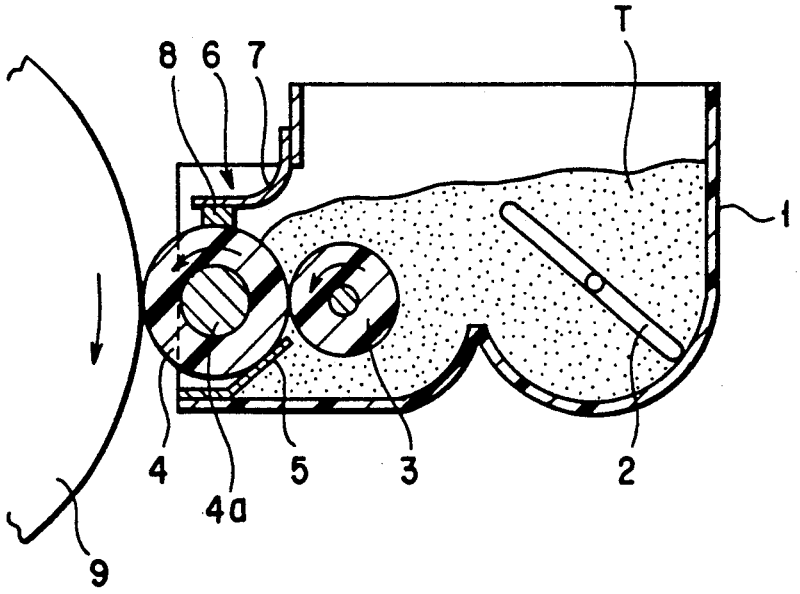
FIG. 40 PRIOR ART
FIG. 40 is a cross-sectional view showing a conventional developing device.

In a toner restricting member 41 as shown in FIG. 39, a hollow hexagonal contact unit 54 is fitted over a hollow hexagonal retaining rod 57 as in the toner restricting member 41 as shown in FIG. 35.

The retaining rod 57 can be made of not only metal but also other rigid substances including rigid synthetic resin.

For a blade-like contact unit formed on the retaining rod, not only four, but also three, or more than four contact areas can be formed on the contact unit.

If a plurality of contact areas of the contact unit are formed into a continuous unit, no restriction is made to its polygonal shape if it is properly selected.

The means for supporting the retaining rod for the toner restricting member is not restricted to those shown in the aforementioned embodiments.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A developing device for depositing a toner comprising:

a casing;

a toner carrier rotatably mounted within the casing and having a surface for receiving a tone; and a tone restricting member nonrotatably mounted within the casing parallel to and urged into contact with the toner carrier, the tone restricting member including a ridge retaining rod and an elastic contact unit secured to an outer surface of the retaining rod, the contact unit extending axially along the retaining rod and having a single contact area with a distal end extending from the retaining rod for contacting the surface of the toner carrier, the contact area extending from the retaining rod to a height smaller than a diameter of the retaining rod;

whereby, upon rotation of the toner carrier, a thin layer of toner is deposited on the toner carrier after passing between the contact unit and the toner carrier.

2. The developing device according to claim 1, wherein the retaining rod is circular in cross-section.

3. The developing device according to claim 1, wherein the retaining rod has an annular cross-section.

4. The developing device according to claim 1, wherein the retaining rod is polygonal in cross-section.

5. The developing device according to claim 1, wherein the retaining rod is hollow and has an angular cross-section.

6. The developing device according to any one of claims 1 to 5, wherein the contact unit includes a section fixed directly to the retaining rod.

7. The developing device according to any one of claims 1 to 5, wherein the contact unit has a base seat secured to the retaining rod and formed integral with and adjacent a proximal end of the contact area in a downstream direction relative to the direction of rotation of the toner carrier.

8. The developing device according to any one of claims 1 to 5, wherein the base seat is formed adjacent the contact area in an upstream and a downstream direction relative to the direction of rotation of the toner carrier.

9. The developing device according to any one of claims 1 to 5, wherein the base seat is annular in cross-section and extends around the outer surface of the retaining rod.

10. A developing device for depositing a toner comprising:

a casing;

a toner carrier rotatably mounted in the casing and having a surface for receiving a toner; and a toner restricting member nonrotatably mounted in the casing in one of a plurality of predetermined positions, in each position the toner restricting member being parallel to and urged into contact with the toner carrier, the toner restricting member including a rigid retaining rod and an elastic contact unit secured to an outer surface of the retaining rod, the contact unit extending axially along the retaining rod and having a plurality of contact areas arranged circumferentially around the retaining rod and extending from the retaining rod for contacting the surface of the toner carrier, one corresponding contact area contacting the toner carrier when the toner restricting member is in a given predetermined position, each contact area extending from the retaining rod to a height smaller than a diameter of the retaining rod;

whereby, upon rotation of the toner carrier, a thin layer of toner is deposited on the toner carrier after passing between the contact unit and the toner carrier.

11. The device according to claim 10, wherein the retaining rod is circular in cross-section.

12. The device according to claim 10, wherein the retaining rod has an annular cross-section.

13. The device according to claim 10, wherein the retaining rod is angular in cross-section.

14. The device according to claim 10, wherein the retaining rod is hollow and angular in cross-section.

15. The developing device according to any one of claims 10 to 14, wherein the contact unit includes a plurality of noncontiguous contact areas circumferentially spaced about and extending from the retaining rod.

16. The developing device according to any one of claims 10 to 14, wherein the contact unit has a base seat which is annular in cross-section and is secured about the outer surface of the retaining rod, the contact areas being arranged around and extending from the base seat.

17. The developing device according to any one of claims 10 to 14, wherein the contact unit has the plurality of contact areas formed into a continuous unit.

18. A method for locating a toner restricting member on a developing device, comprising the steps of:

preparing a toner restricting member including a rigid retaining rod and an elastic contact unit, the contact unit being secured to an outer surface of the retaining rod and having at least one contact area extending from the retaining rod to a height smaller than a diameter of the retaining rod; and setting the toner restricting member parallel with a toner carrier and setting the contact area in contact with the outer surface of the toner carrier.

19. The device according to claim 10, further including two mounting members, each mounting member secured to one end of the retaining rod, the casing defining two openings, each opening for nonrotatably receiving a mounting member in one of a plurality of predetermined positions.

20. The device according to claim 19, wherein the mounting members and openings have a square cross-section.

21. The device according to claim 19, wherein the mounting members have a hexagonal cross-section and the openings have a square cross-section.

22. The device according to claim 10, wherein the contact unit has an outer surface with an angular cross-section and is secured about the outer surface of the retaining rod.

23. The device according to claim 22, wherein the contact unit has an outer surface with a hexagonal cross-section and is secured about the outer surface of the retaining rod.

24. A method for mounting a toner restricting member in a developing device, comprising the steps of:

rotatably mounting a toner carrier within a casing of a developing device;

nonrotatably mounting a toner restricting member within the casing in one of a plurality of predetermined positions, in each position the toner restricting member being parallel to and urged into contact with the toner carrier, the toner restricting member including a contact unit having a plurality of contact areas for contacting the toner carrier, one corresponding contact area contacting the toner carrier when the toner restricting member is in a given predetermined position.

25. A method as in claim 24, comprising the additional steps of:

unmounting the toner restricting member from the predetermined position within the casing to thereby separate the corresponding contact area from the toner carrier;

remounting the toner restricting member nonrotatably within the casing in a different predetermined position so that a different corresponding contact area contacts the toner carrier.

* * * * *